US007802847B2

(12) United States Patent
Chou

(10) Patent No.: US 7,802,847 B2
(45) Date of Patent: Sep. 28, 2010

(54) ANGLE-ADJUSTING STRUCTURE FOR BACKREST OF CHAIR

(76) Inventor: Kuo-Ching Chou, No. 2, Lane 116, Beizaidian, Guangwun Village, Shanhua Township, Tainan County (TW)

( * ) Notice: Subject to any disclaimer, the term of this patent is extended or adjusted under 35 U.S.C. 154(b) by 20 days.

(21) Appl. No.: 12/335,706

(22) Filed: Dec. 16, 2008

(65) Prior Publication Data

US 2010/0148556 A1 Jun. 17, 2010

(51) Int. Cl.
*A47C 1/024* (2006.01)
*A47C 1/038* (2006.01)
*A47C 3/025* (2006.01)
*A47C 3/026* (2006.01)

(52) U.S. Cl. ..... 297/296; 297/285; 297/289; 297/292; 297/293; 297/297; 297/298; 297/299; 297/301.4

(58) Field of Classification Search ..... 297/285, 297/289, 292, 293, 296, 297, 298, 299, 301.4, 297/354.12
See application file for complete search history.

(56) References Cited

U.S. PATENT DOCUMENTS 1,927,491 A * 9/1933 Gabb ..... 297/358
2,845,994 A * 8/1958 Thompson ..... 297/358
3,351,379 A * 11/1967 Street ..... 297/358
3,603,640 A * 9/1971 Doerner ..... 297/292
3,710,418 A * 1/1973 Kratzer ..... 16/325
4,720,142 A * 1/1988 Holdredge et al. ..... 297/293 X
4,756,575 A * 7/1988 Dicks ..... 297/285 X
5,282,670 A * 2/1994 Karsten et al. ..... 297/301.6 X
5,511,852 A * 4/1996 Kusiak et al. ..... 297/301.4
5,676,425 A * 10/1997 Pernicka ..... 297/374
5,725,276 A * 3/1998 Ginat ..... 297/289
5,782,536 A * 7/1998 Heidmann et al. .... 297/301.1 X
5,873,634 A * 2/1999 Heidmann et al. .... 297/301.1 X
5,951,109 A * 9/1999 Roslund et al. ..... 297/299 X
6,039,397 A * 3/2000 Ginat ..... 297/289
6,959,965 B2 * 11/2005 Diffrient ..... 297/320
7,249,801 B2 * 7/2007 Tonin ..... 297/289 X
7,445,287 B2 11/2008 Chou
2008/0252124 A1 * 10/2008 Chen ..... 297/301.4

FOREIGN PATENT DOCUMENTS

TW M308020 3/2007

* cited by examiner

*Primary Examiner*—Rodney B White
(74) *Attorney, Agent, or Firm*—Alan Kamrath; Kamrath & Associates PA

(57) ABSTRACT

An angle-adjusting structure for a backrest of a chair is mounted at a rear side of a butterfly-shaped mounting member of the chair. The angle-adjusting structure includes a main body and a rotating member jointly passed through by a shaft having external teeth. A resilient element is mounted around an end of the shaft. A cover is secured to the main body by threaded fasteners. A pressing member is mounted on the other end of the shaft. By pressing the pressing member inward, the external teeth of the shaft are disengaged from internal teeth of the rotating member, and the rotating member is allowed to rotate freely. When the pressing member is released, the resilient element mounted around the end of the shaft extends outward to re-engage the external teeth of the shaft with the internal teeth of the rotating member, thereby securing the rotating member in place.

4 Claims, 7 Drawing Sheets

ANGLE-ADJUSTING STRUCTURE FOR BACKREST OF CHAIR

BACKGROUND OF THE INVENTION

1. Technical Field

The present invention relates to an adjusting structure for a backrest of a chair and, more particularly, to an angle-adjusting structure to be assembled to a backrest of a chair for adjusting the backrest to desired angular positions in a simple and convenient way.

2. Description of Related Art

Nowadays, chairs are provided with different functions for specific occasions and uses to suit consumers' various needs. These functionally enhanced chairs have predetermined shapes and are further incorporated with ergonomic mechanisms in their seats, backrests and armrests to furnish a certain degree of sitting comfort.

For the adjustment of backrests of chairs, the inventor of the present invention proposed "Structural Improvement of Chair" and was granted Taiwan Patent No. M308020 therefor. The aforesaid patented chair has a backrest capable of angular adjustment in a predetermined manner. However, the backrest makes only partial and limited contact with a user's back and thus does not provide sufficient comfortableness.

BRIEF SUMMARY OF THE INVENTION

The present invention provides an improved design of an adjusting structure for a backrest having the same features as those of the backrest of the aforesaid patented chair and intended for a user to rest his/her back comfortably against. It is hoped that the user can adjust the backrest of a chair to predetermined angles in a simple and convenient way, so that the backrest not only makes contact with, but also completely conforms to, the user's back ergonomically and comfortably while the user is sitting in the chair.

A primary objective of the present invention is to provide an angle-adjusting structure for a backrest of a chair. The angle-adjusting structure, mounted at a rear side of a butterfly-shaped mounting member of the chair, includes a main body and a rotating member which are formed respectively with internal holes jointly passed through by a shaft having external teeth. A resilient element is mounted around an end of the shaft. A cover is secured to the main body by threaded fasteners. A pressing member is mounted on an opposite end of the shaft adjacent to an outer wall of the main body. By pressing the pressing member inward, the external teeth of the shaft are disengaged from internal teeth of the rotating member, and the rotating member is allowed to rotate freely. When the pressing member is released, the resilient element mounted around the end of the shaft extends outward to re-engage the external teeth of the shaft with the internal teeth of the rotating member, thereby securing the rotating member in place.

BRIEF DESCRIPTION OF THE SEVERAL VIEWS OF THE DRAWINGS

The invention as well as a preferred mode of use, further objectives and advantages thereof will be best understood by referring to the following detailed description of an illustrative embodiment in conjunction with the accompanying drawings, wherein.

DETAILED DESCRIPTION OF THE INVENTION

Figure 1:
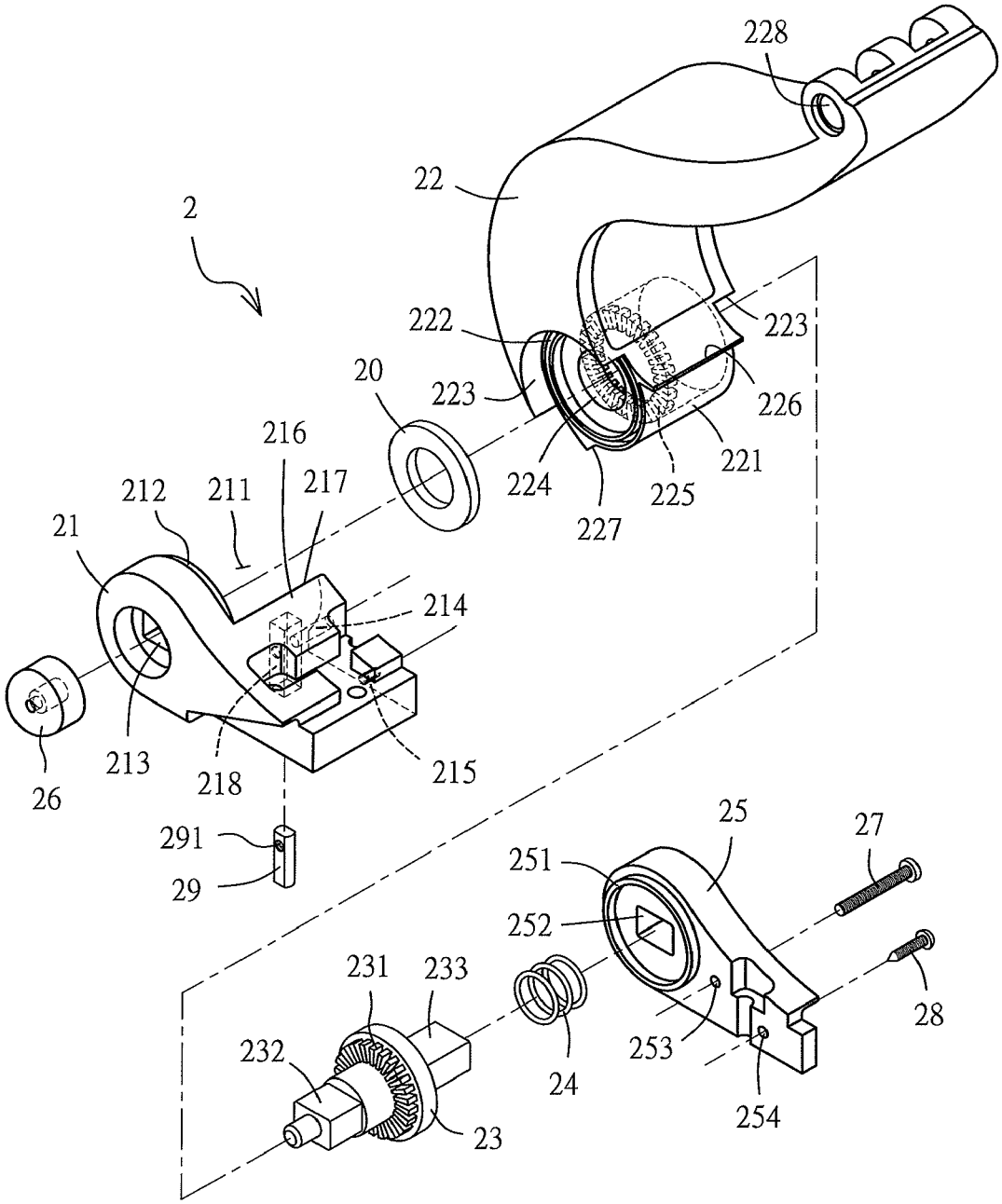
FIG. 1 is an exploded, perspective view of an angle-adjusting structure for a backrest of a chair according to the present invention.
Figure 2:
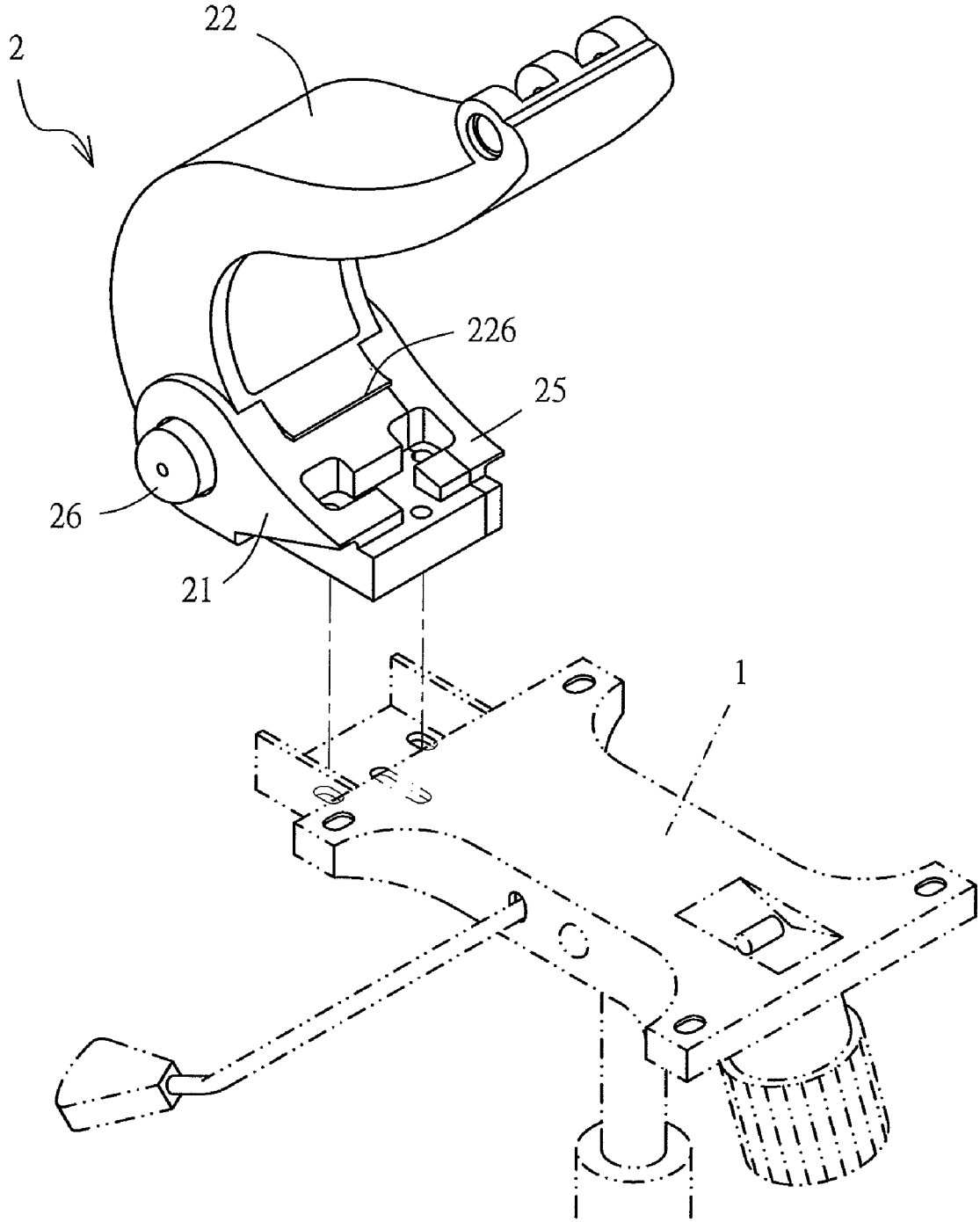
FIG. 2 is a schematic, perspective view showing installation of the angle-adjusting structure for a backrest of a chair according to the present invention onto a butterfly-shaped member of the chair.

Referring to FIGS. 1 and 2, an angle-adjusting structure 2 for a backrest of a chair according to the present invention is mounted at a rear side of a butterfly-shaped mounting member 1 of the chair and includes a main body 21, a rotating member 22, a shaft 23, a resilient element 24, a cover 25, a pressing member 26, and plural threaded fasteners 27 and 28.

The main body 21 has a flat bottom and a rear side formed with a cavity 211 and an engaging portion 212 which is located beside the cavity 211 and has an internal hole 213. Holes 214 and 215 are formed at an opposite side of the main body 21 for the threaded fasteners 27 and 28 to screw into, respectively.

The rotating member 22 has one end defined as a connecting section 221 formed with an annular groove 222. The connecting section 221 is bilaterally and protrudingly provided with abutting portions 223 and formed with an internal hole 224 having internal teeth 225. Restricting portions 226 and 227 are formed along an upper part and a lower part of the connecting section 221, respectively. A pivot hole 228 is formed at an opposite end of the rotating member 22 for coupling with a backrest 3.

The shaft 23 has one side formed with external teeth 231 corresponding to the internal teeth 225 of the rotating member 22. In addition, the shaft 23 is bilaterally formed with inserting sections 232 and 233 having particular cross-sectional shapes, which must be non-circular and are rectangular in the present embodiment.

The cover 25, which is shaped according to an outer contour of the main body 21, has a side formed with an engaging portion 251 having an internal hole 252. The cover 25 further has an outer side formed with holes 253 and 254.

Figure 4:
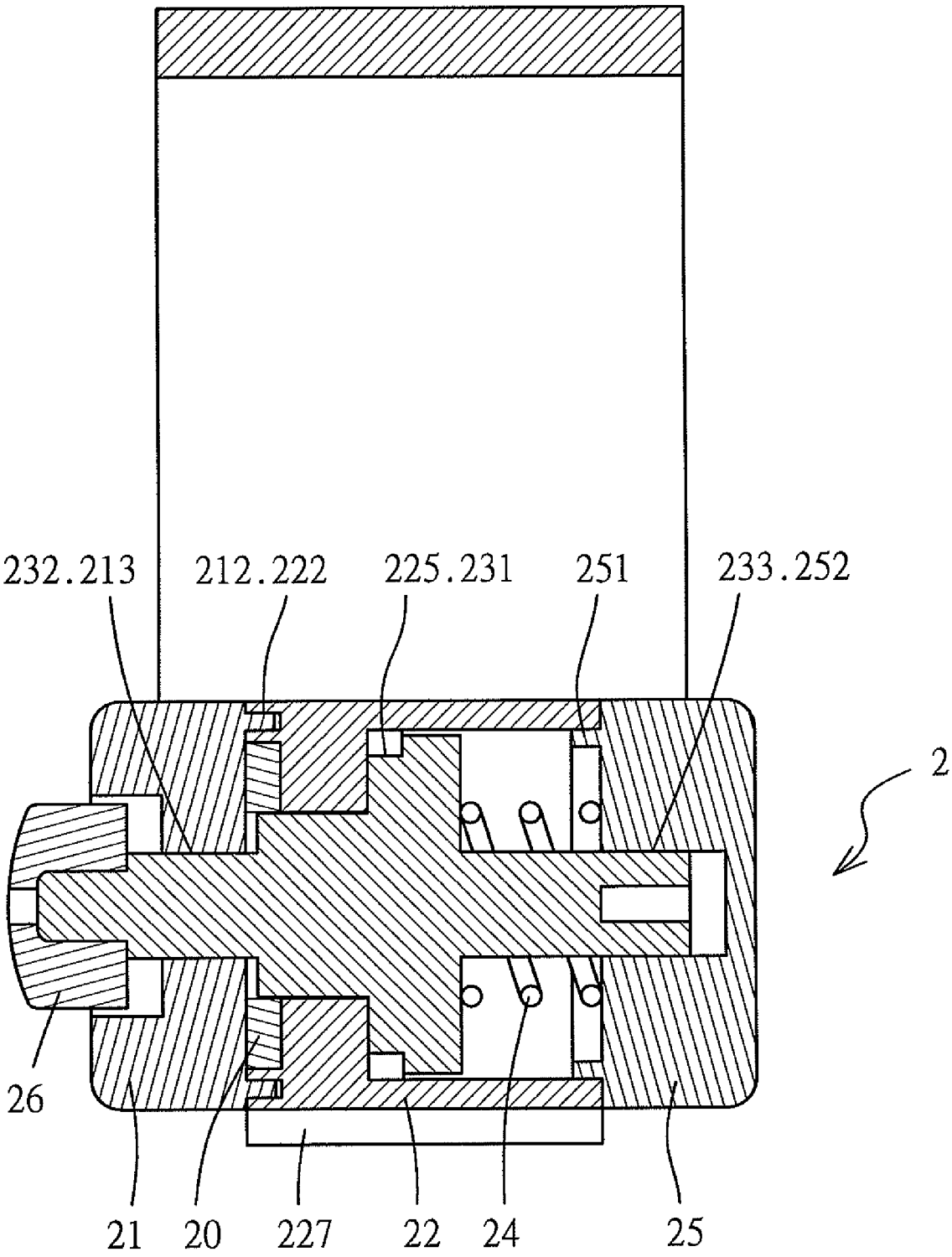
FIG. 4 is a schematic, sectional view taken along a line 40-40 in FIG. 3.

Referring to FIGS. 1 and 4, in order to assemble the angle-adjusting structure 2, the shaft 23 is inserted into the internal hole 224 of the rotating member 22 and the internal hole 213 of the main body 21 sequentially. The resilient element 24 is mounted around an end of the shaft 23. Then, the cover 25 is secured to the main body 21 with the threaded fasteners 27 and 28. Finally, the pressing member 26 is mounted on an opposite end of the shaft 23 adjacent to an outer wall of the main body 21, before the particularly shaped backrest 3 is pivotally coupled to the pivot hole 228 of the rotating member 22.

Figure 3:
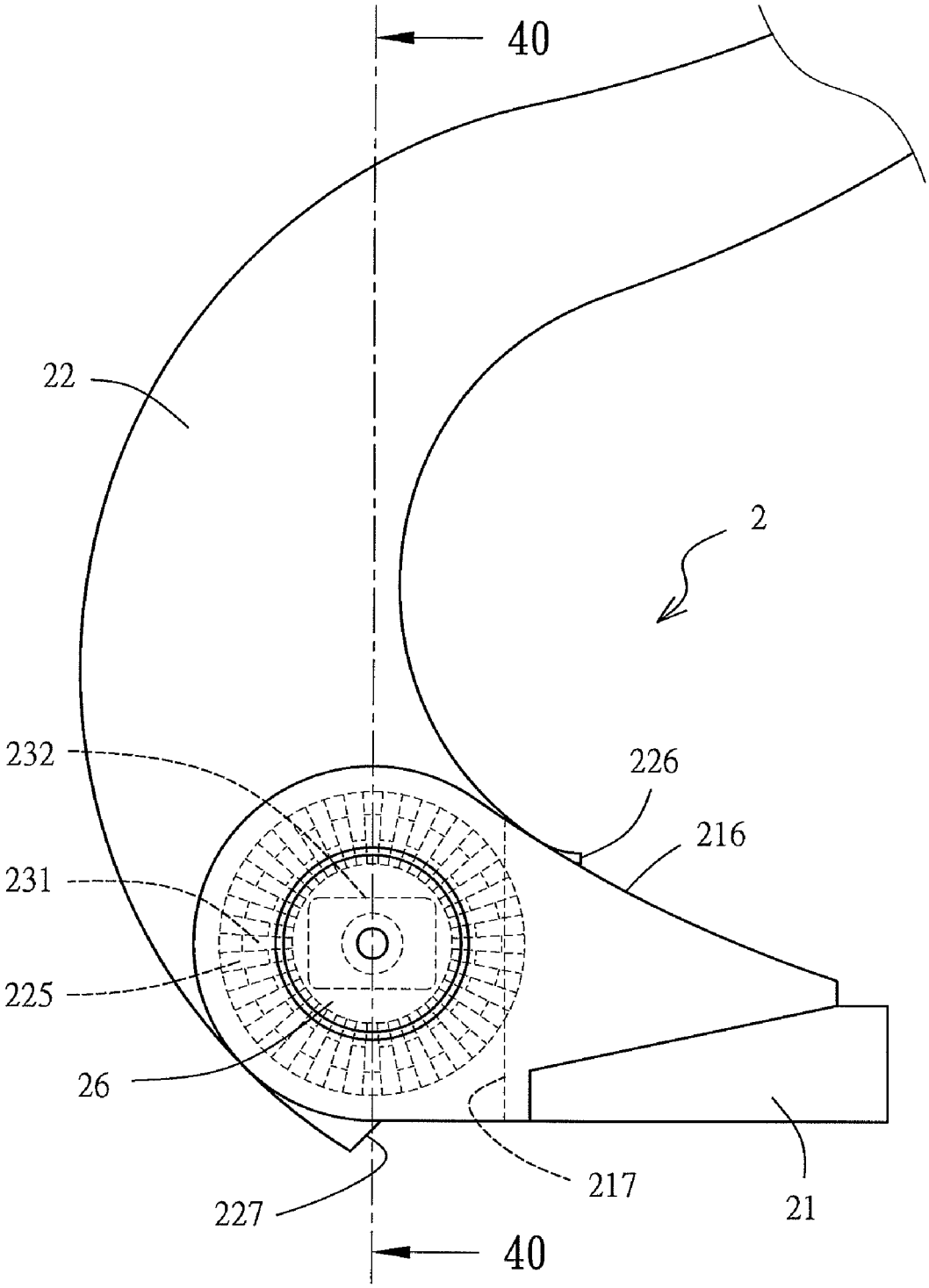
FIG. 3 is a schematic, left-side view of the angle-adjusting structure for a backrest of a chair according to the present invention.
Figure 5:
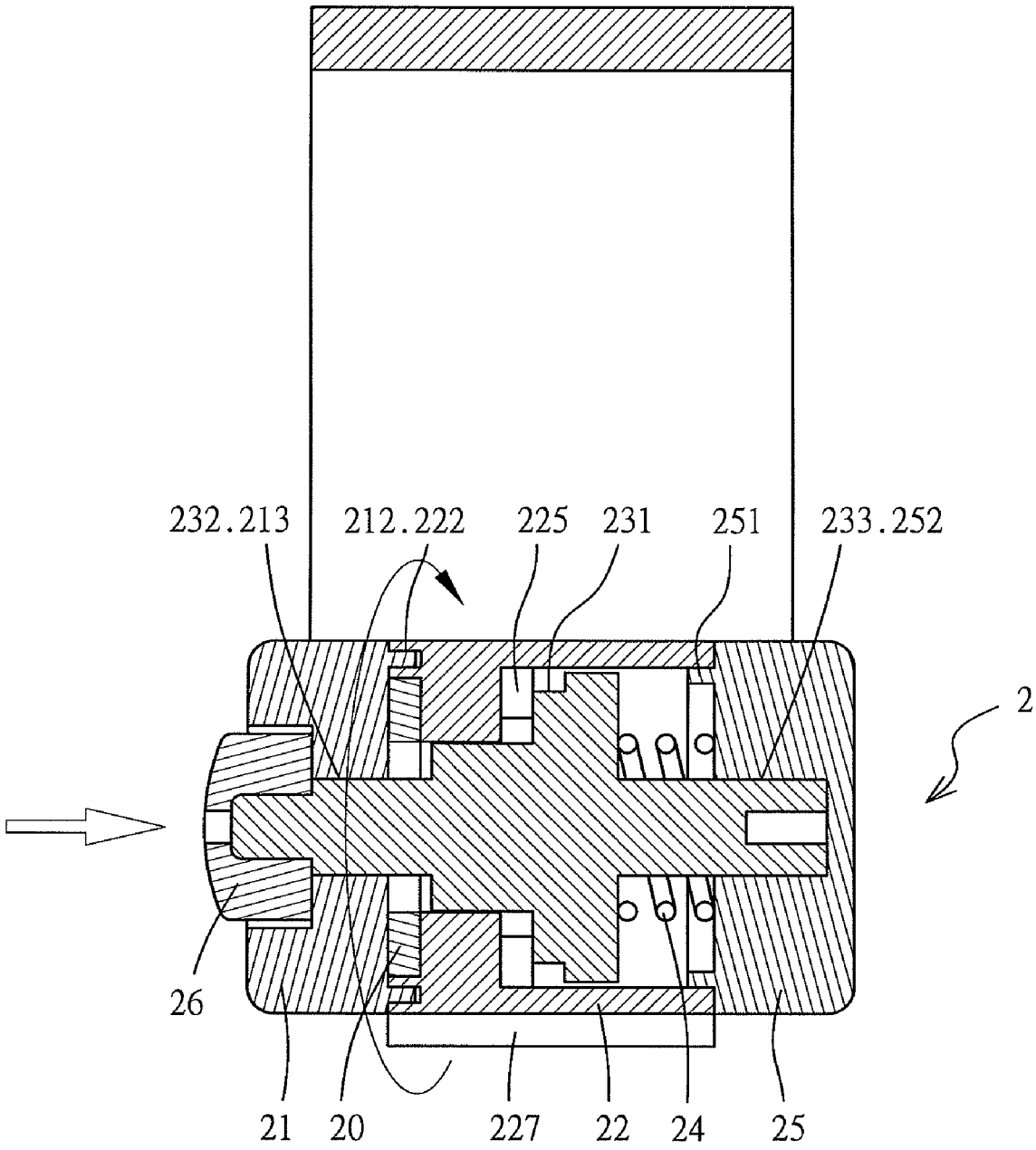
FIG. 5 is a schematic, sectional view showing actuation of the angle-adjusting structure for a backrest of a chair according to the present invention.
Figure 6:
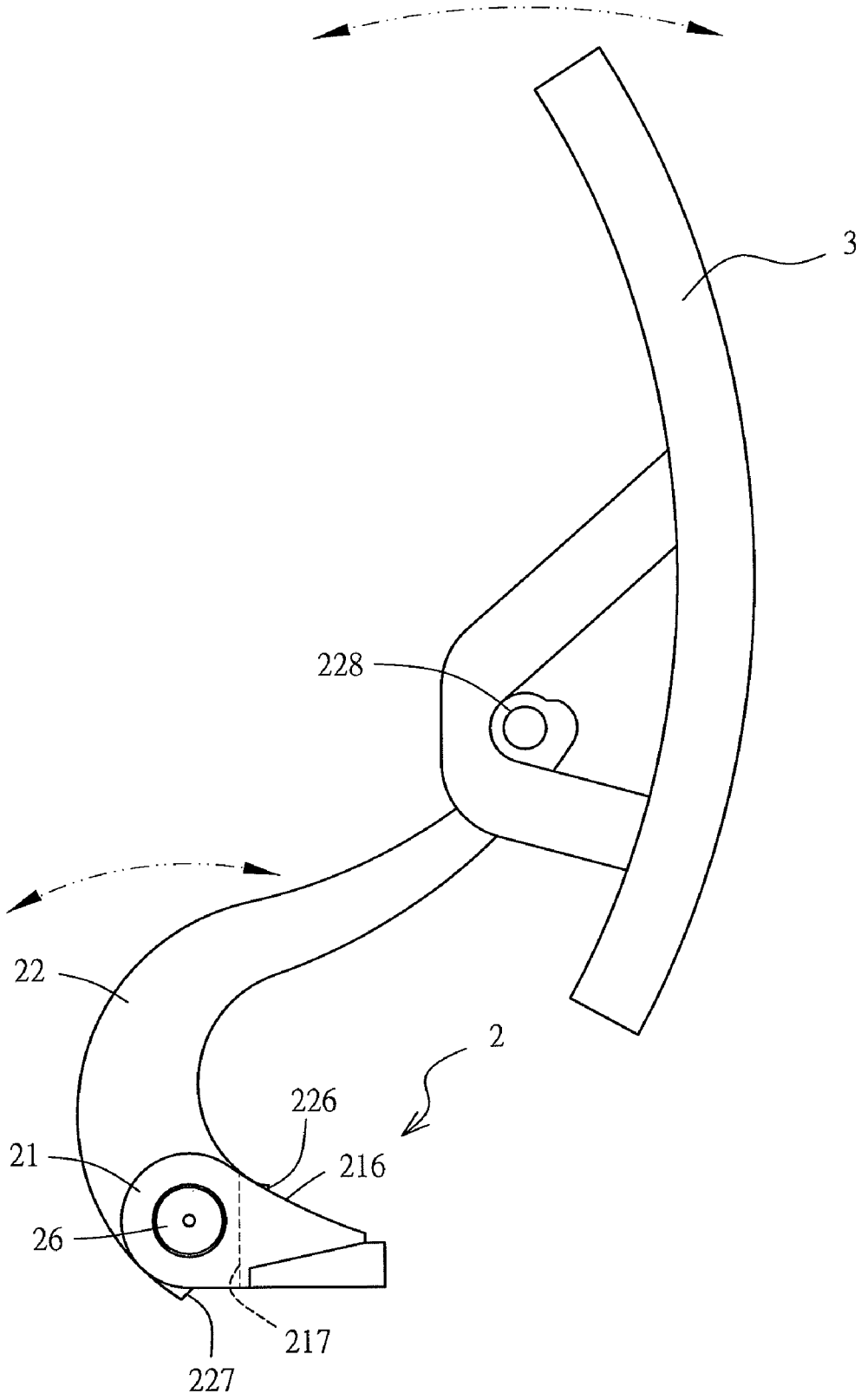
FIG. 6 is a schematic, left-side view of the angle-adjusting structure for a backrest of a chair according to the present invention when attached with the backrest.
Figures 7, 7A, 7B:
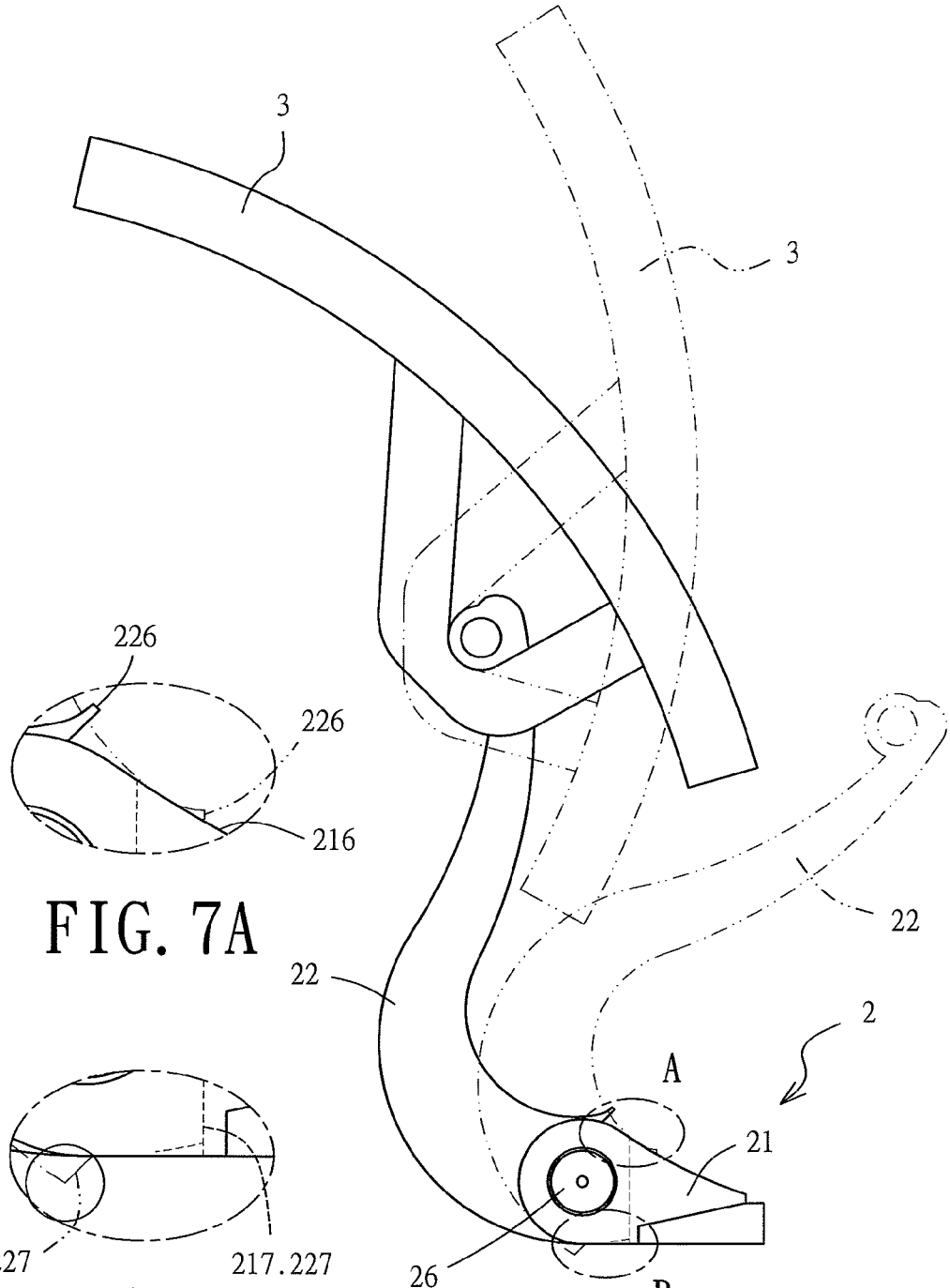
FIG. 7 is a schematic, left-side view showing actuation the angle-adjusting structure for a backrest of a chair according to the present invention, wherein circled areas A and B are presented as partial, enlarged views in FIGS. 7A and 7B, respectively.

Referring now to FIGS. 3 and 5, angular adjustment is achieved by the angle-adjusting structure 2 according to the present invention in the following manner. The pressing member 26 is pushed inward to disengage the external teeth 231 of the shaft 23 from the internal teeth 225 of the rotating member 22, thereby allowing the rotating member 22 to rotate freely (as shown in FIGS. 5 and 6). When the pressing member 26 is released, the resilient element 24 mounted around the end of the shaft 23 pushes outward to re-engage the external teeth 231 of the shaft 23 with the internal teeth 225 of the rotating member 22. As a result, the rotating member 22 is stably secured in place (as shown in FIGS. 4 and 7). In addition to the angular adjustment enabled by the angle-adjusting structure 2, the particularly shaped backrest 3 pivotally coupled to the pivot hole 228 of the rotating member 22 is also adjustable angularly with respect to the angle-adjusting structure 2 (as shown in FIG. 7), so that the backrest 3 conforms in its entirety to a user's back ergonomically and comfortably while the user is sitting in the chair.

An allowable range of angular adjustment of the rotating member 22 is defined by the restricting portions 226 and 227 formed respectively on the upper and lower parts of the connecting section 221. A forward limit of the range is reached when the restricting portion 226 abuts against a forward surface 216 of the main body 21 (as shown in FIG. 7A), and a backward limit of the range is reached when the restricting portion 227 abuts against a wall 217 of the cavity 211 of the main body 21 (as shown in FIG. 7B). The restricting portions 226 and 227 are configured to prevent the rotating member 22 from being rotated to an angle which is too small for the user to sit in the chair or an angle which is so large as to incur danger.

In addition, as shown in FIG. 1, the bottom of the main body 21 according to the present invention is formed with a slot 218 in communication with the hole 214 for receiving a metal fastener 29 having a threaded hole 291, so that the threaded fastener 27 is fastened in the hole 214 with enhanced tightness.

Also, a washer 20 made of a resilient material, such as rubber, EVA, PVC, and so on, is interposed between the rotating member 22 and the main body 21, as shown in FIG. 1, to enhance tightness between the rotating member 22 and the main body 21.

The invention claimed is:

1. An angle-adjusting structure for a backrest of a chair, the angle-adjusting structure being mounted at a rear side of a butterfly-shaped mounting member of the chair and comprising:

a main body formed with an internal hole;

a rotating member having a connecting section formed with an internal hole provided with internal teeth;

a shaft having external teeth and passing through the internal holes of the main body and of the connecting section of the rotating member;

a resilient element mounted around an end of the shaft;

a cover secured to the main body by a threaded fastener; and a pressing member mounted on an opposite end of the shaft adjacent to an outer wall of the main body;

wherein by pressing the pressing member inward, the external teeth of the shaft are disengaged from the internal teeth of the rotating member, allowing the rotating member to rotate freely, and when the pressing member is released, the resilient element mounted around the end of the shaft extends outward to re-engage the external teeth of the shaft with the internal teeth of the rotating member, thereby securing the rotating member in place; and wherein the connecting section of the rotating member has an upper part and a lower part which are formed with restricting portions, respectively, to prevent the rotating member from being rotated to an excessively small or excessively large angle.

2. An angle-adjusting structure for a backrest of a chair, the angle-adjusting structure being mounted at a rear side of a butterfly-shaped mounting member of the chair and comprising:

a main body formed with an internal hole;

a rotating member having a connecting section formed with an internal hole provided with internal teeth;

a shaft having external teeth and passing through the internal holes of the main body and of the connecting section of the rotating member;

a resilient element mounted around an end of the shaft;

a cover secured to the main body by a threaded fastener; and a pressing member mounted on an opposite end of the shaft adjacent to an outer wall of the main body;

wherein by pressing the pressing member inward, the external teeth of the shaft are disengaged from the internal teeth of the rotating member, allowing the rotating member to rotate freely, and when the pressing member is released, the resilient element mounted around the end of the shaft extends outward to re-engage the external teeth of the shaft with the internal teeth of the rotating member, thereby securing the rotating member in place; and wherein the main body has a bottom formed with a slot in communication with a hole formed in the main body for receiving the threaded fastener, the slot receiving therein a metal fastener having a threaded hole so that the threaded fastener is fastened in the hole with enhanced tightness.

3. An angle-adjusting structure for a backrest of a chair, the angle-adjusting structure being mounted at a rear side of a butterfly-shaped mounting member of the chair and comprising:

a main body formed with an internal hole;

a rotating member having a connecting section formed with an internal hole provided with internal teeth;

a shaft having external teeth and passing through the internal holes of the main body and of the connecting section of the rotating member;

a resilient element mounted around an end of the shaft;

a cover secured to the main body by a threaded fastener; and a pressing member mounted on an opposite end of the shaft adjacent to an outer wall of the main body;

wherein by pressing the pressing member inward, the external teeth of the shaft are disengaged from the internal teeth of the rotating member, allowing the rotating member to rotate freely, and when the pressing member is released, the resilient element mounted around the end of the shaft extends outward to re-engage the external teeth of the shaft with the internal teeth of the rotating member, thereby securing the rotating member in place; and wherein the rotating member and the main body sandwich therebetween a washer made of a resilient material to enhance tightness between the rotating member and the main body.

4. An angle-adjusting structure for a backrest of a chair, the angle-adjusting structure being mounted at a rear side of a butterfly-shaped mounting member of the chair and comprising:

a main body formed with an internal hole;

a rotating member having a connecting section formed with an internal hole provided with internal teeth;

a shaft having external teeth and passing through the internal holes of the main body and of the connecting section of the rotating member;

a resilient element mounted around an end of the shaft;

a cover secured to the main body by a threaded fastener; and a pressing member mounted on an opposite end of the shaft adjacent to an outer wall of the main body;

wherein by pressing the pressing member inward, the external teeth of the shaft are disengaged from the internal teeth of the rotating member, allowing the rotating member to rotate freely, and when the pressing member is released, the resilient element mounted around the end of the shaft extends outward to re-engage the external teeth of the shaft with the internal teeth of the rotating member, thereby securing the rotating member in place; and wherein the shaft is bilaterally formed with inserting sections having non-circular cross-sectional shapes.

* * * * *